United States Patent [19]

Rapp et al.

[11] Patent Number: 5,037,165

[45] Date of Patent: Aug. 6, 1991

[54] DRAWER ORGANIZER COMPRISING READILY ATTACHABLE LOW FRICTION SLIDES AND MOVABLE TRAY

[75] Inventors: William M. Rapp, Arlington Heights; Joseph A. Gaines, des Plaines, both of Ill.

[73] Assignee: Vance Industries, Inc., Chicago, Ill.

[21] Appl. No.: 577,907

[22] Filed: Sep. 5, 1990

[51] Int. Cl.[5] ..... A47B 88/00

[52] U.S. Cl. ..... 312/330.1; 248/215; 248/340; 248/201; 248/231.8

[58] Field of Search ..... 312/126, 131, 132, 330.1; 248/215, 340, 201, 231.8

[56] References Cited

U.S. PATENT DOCUMENTS 3,490,823 1/1970 Neu et al. ..... 312/330.1
3,599,918 8/1971 Patchett ..... 248/215 X
3,989,213 11/1976 Allen ..... 248/231.8
4,960,307 10/1990 Nelsen ..... 312/330 X

*Primary Examiner*—Joseph Falk
*Attorney, Agent, or Firm*—McCaleb, Lucas & Brugman

[57] ABSTRACT

A drawer organizer consists of a pair of glides and a tray movable on the glides. The glides are extrusions of low-friction plastic material. Each glide comprises a pair of side walls interconnected by a top wall defining a downwardly open groove and is assembled without tools by pressing the downwardly open groove onto the upper edge of a corresponding drawer side. The glides have generally transverse longitudinal flanges inside the drawer at levels below the tops of the drawer sides and support opposite flanges of a tray for movement within the drawer. At least one of the side walls of the glide is diagonal to enable the downwardly open groove to elastically grip the drawer sides fit to different drawer side thicknesses.

14 Claims, 4 Drawing Sheets

DRAWER ORGANIZER COMPRISING READILY ATTACHABLE LOW FRICTION SLIDES AND MOVABLE TRAY

BACKGROUND OF THE INVENTION

Typically, one or more special drawers of a kitchen cabinet are "organizers", having compartments for silverware, knives, and miscellaneous small tools. Some of these special drawers have permanent dividers. Others may have replaceable organizer trays which are available in a wide variety of compartment configurations, one example being shown in U.S. Design Pat. No. 301,590 issued June 13, 1989 to Rubbermaid Incorporated on "Drawer Organizer Tray".

Whether the compartments are permanent, or are in a replaceable organizer tray, they generally occupy only the lower space portion of the drawer, leaving a substantial upper space portion unused.

Attempts have been made to utilize this wasted upper space portion by fitting an additional, movable, auxiliary organizer tray in it. This has required tools and permanent installation of special guide rails which, if removed, leave the drawer side defaced with nail holes or other imperfections. An example is shown in Swiss Patent No. 269758 filed 28 Oct. 1948 where an auxiliary tray 3 is supported for movement on permanent rails 5, 5 in the upper portion of a cash drawer 1. Removal of these permanent rails would require special tools and would mar the inner surfaces of the drawer.

SUMMARY OF THE INVENTION

The general object of this invention is to provide a drawer organizer which can be mounted without tools or drawer modifications and readily removed without defacing the drawer in any way.

It is a primary object of the invention to provide a drawer organizer comprising a pair of glides which can be pressed onto the top edges of the door sides, plus a tray movable back and forth on the glides. These can be removed without defacing the drawer b simply pulling off the glides.

Another object is to provide the slides in the form of elongated extrusions of elastic low-friction material such as nylon or teflon, each having a downwardly open groove and a horizontal flange extending into the drawer and which can be assembled simply by snapping the glides down onto the top edges of the drawer sides, and then placing the tray on the flanges for sliding movement back and forth.

Another object is to provide each of the slides with a pair of side walls interconnected by a top wall and defining a downwardly open groove of elastically variable width engageable with drawer sides of various thicknesses.

Another object is to provide at least one of the side walls of each slide with a diagonal orientation making the downwardly open groove narrower at the bottom than at the top and elastically biased toward the other side wall to thereby elastically grip the drawer side and accommodate different drawer side thicknesses.

BRIEF DESCRIPTION OF THE DRAWINGS

Other objects and advantages will be apparent from the following description taken in connection with the drawings in which.

Like parts are designated by like reference characters throughout the drawings.

DESCRIPTION OF THE PREFERRED EMBODIMENT

Figure 1:
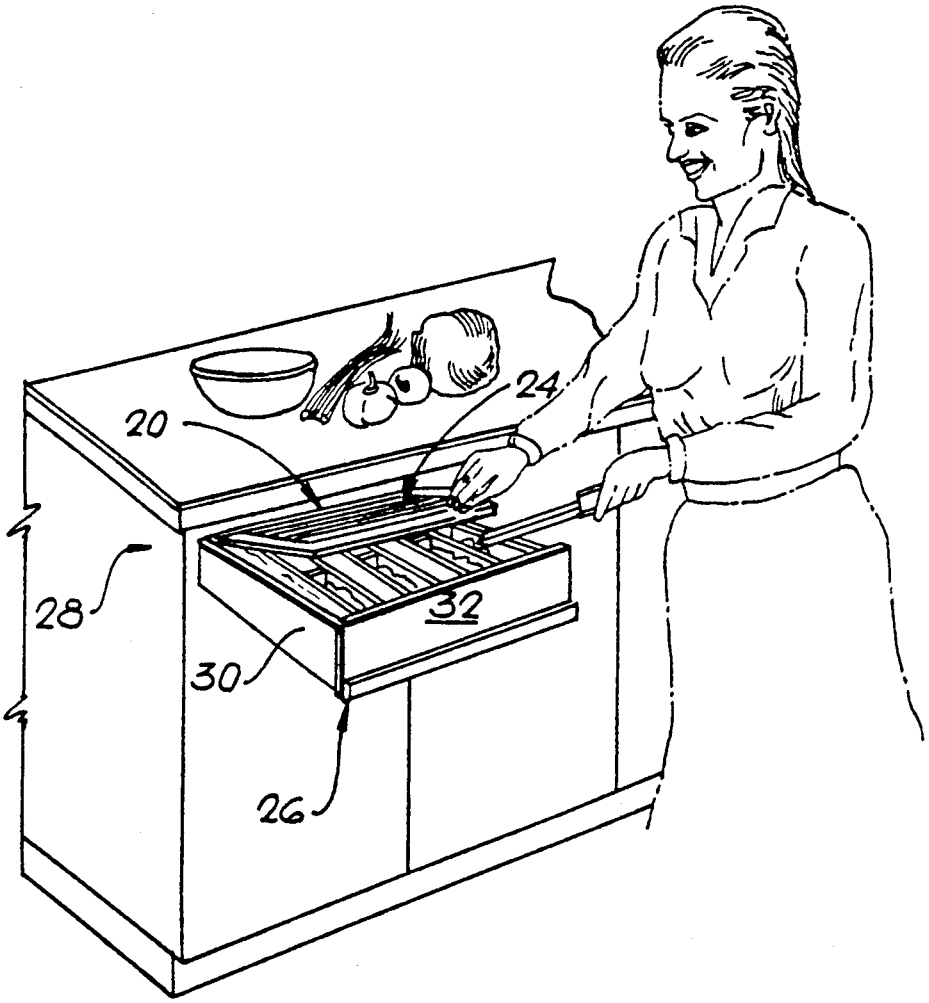
FIG. 1 is a fragmentary perspective view of a kitchen cabinet illustrating a preferred embodiment of the present invention with one form of organizer tray.
Figure 7:
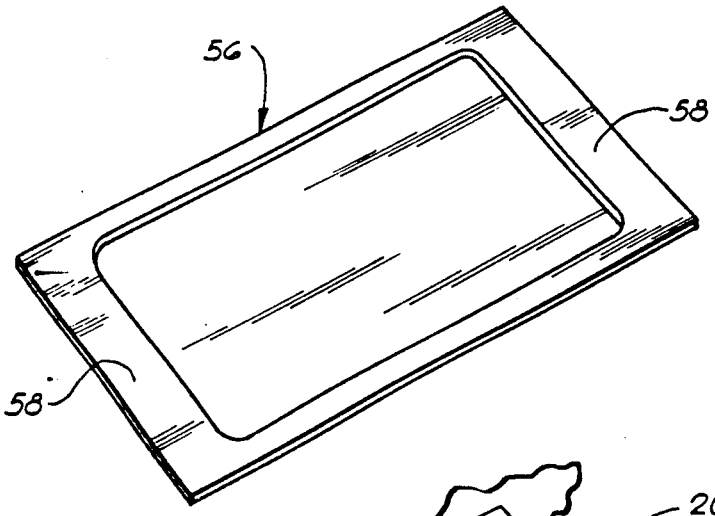
FIG. 7 is a modified form of tray useful with the present invention.
Figure 2:
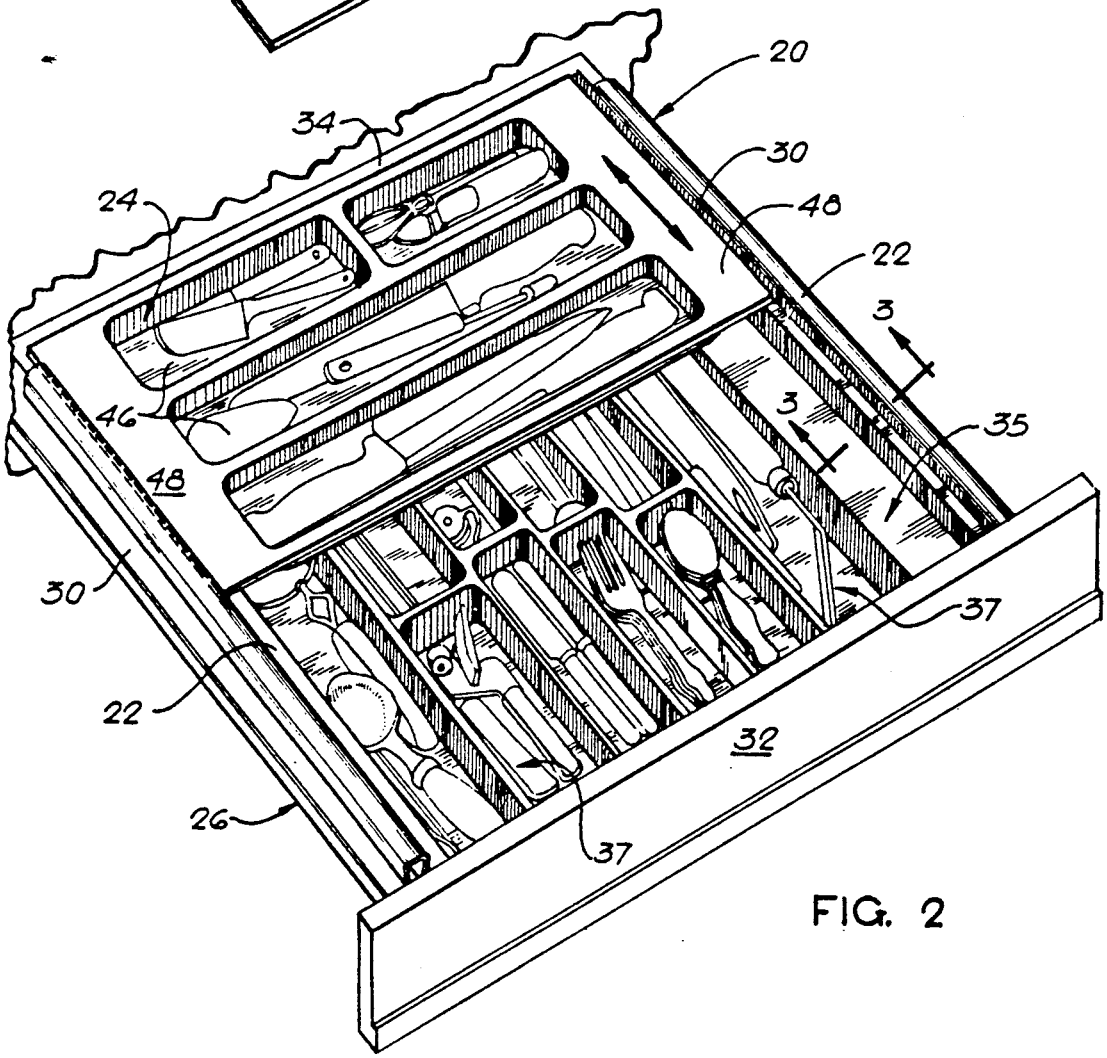
FIG. 2 is a fragmentary, enlarged perspective view of FIG. 1.

Referring now more particularly to the preferred embodiment shown, the drawer organizer is generally designated 20 and comprises a pair of glides, 22, 22 and a movable auxiliary organizer tray 24 in a drawer 26 of a kitchen cabinet 28. Drawer 26 has a pair of sides 30, 30, a front end 32 and a rear end 34. In the lower part of the drawer there is a main organizer tray 35, with compartments, supported on the drawer bottom 39.

Each glide 22 comprises a linearly extruded body of nylon, teflon, vinyl plastic or other suitable low-friction elastically deflectible material. Each glide has inner and outer side walls 36 and 38 respectively, interconnected by an upwardly-convex, curved top wall 40. The side walls 36 and 38, and top wall 40 define a downwardly open groove 42.

Figure 5:
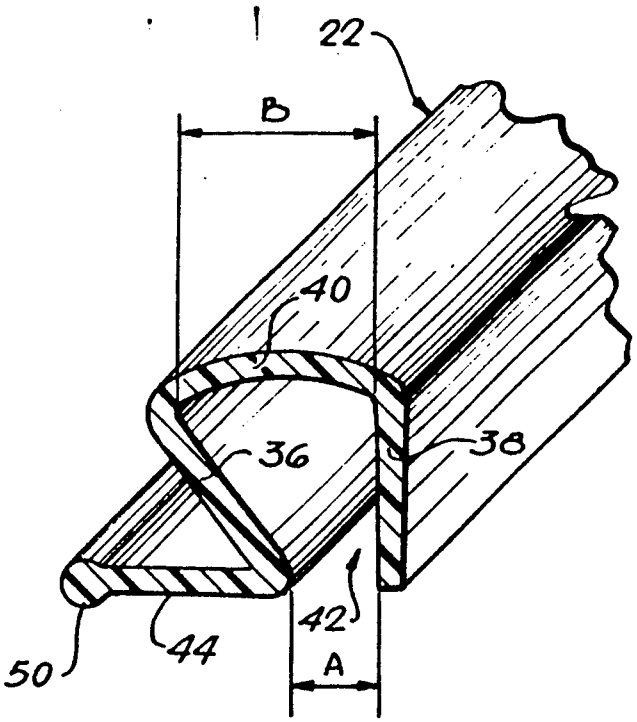
FIG. 5 is a fragmentary perspective view of one of the glides showing a further enlargement of the cross section beyond that shown in FIG. 4.

The groove 42 is narrower at the bottom than at the top enabling the side and top walls 36, 40 to deflect as needed to elastically grip drawer sides of different thicknesses. As best shown in FIG. 5, the bottom open end of groove 42 may be initially extruded with a width A of $\frac{1}{4}''$ and a width B on the underside of the top wall 40 of $\frac{1}{2}''$ for a kitchen cabinet drawer where the sides are typically $\frac{3}{8}''$ thick. The inner wall 36 is diagonal, and may be inclined in the order of 30° to 60° relative to the vertical.

Figure 4:
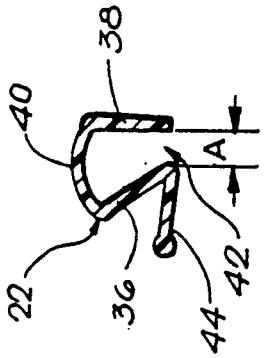
FIG. 4 is a transverse cross-section of one of the glides shown in FIG. 3, to the same scale as FIG. 3, showing the glide unattached and with its downwardly open groove at its minimum opening, before attachment to a drawer.

Each glide 22 has a generally transverse, horizontal flange 44 extending lengthwise along the diagonal side wall 36, on the inner surface 54 of the drawer side. As shown in FIGS. 4 and 5, the transverse flange 44 is substantially horizontal, that is, at right angles to the outer wall 38 when formed, and before assembly.

Figure 3:
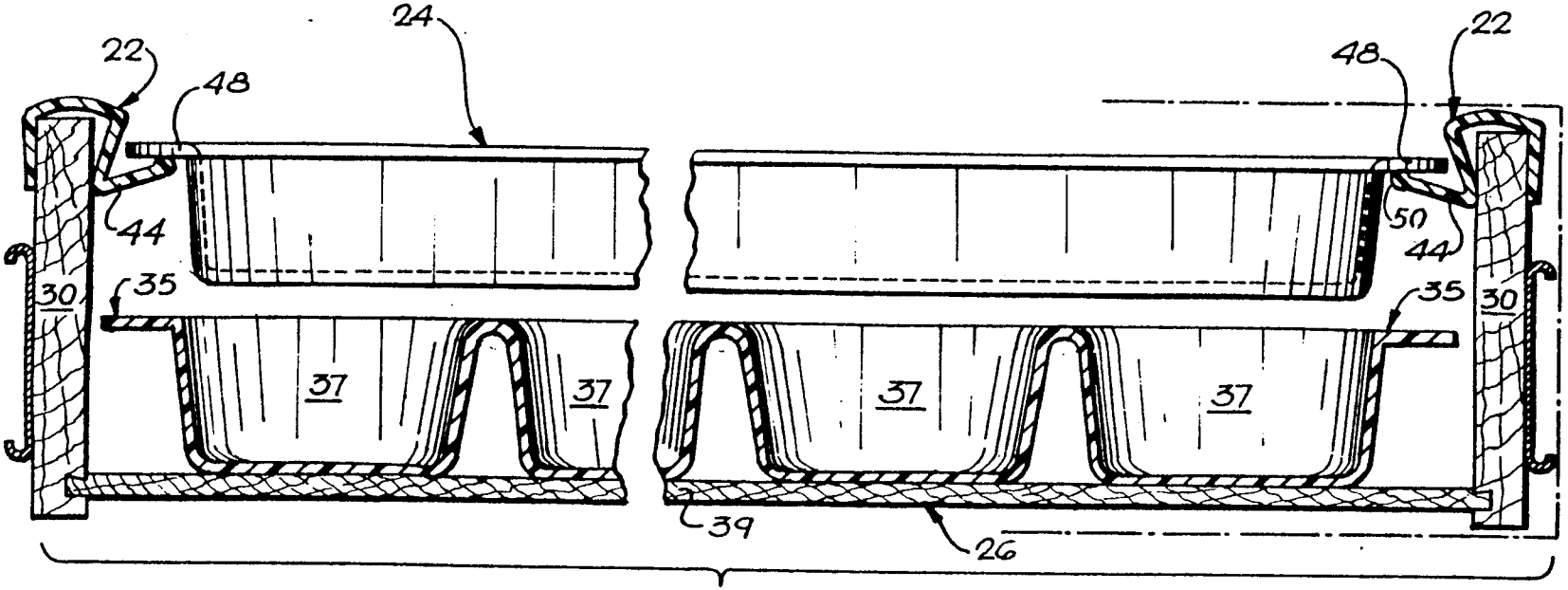
FIG. 3 is an enlarged fragmentary cross section of FIG. 2 taken on line 3—3.
Figure 6:
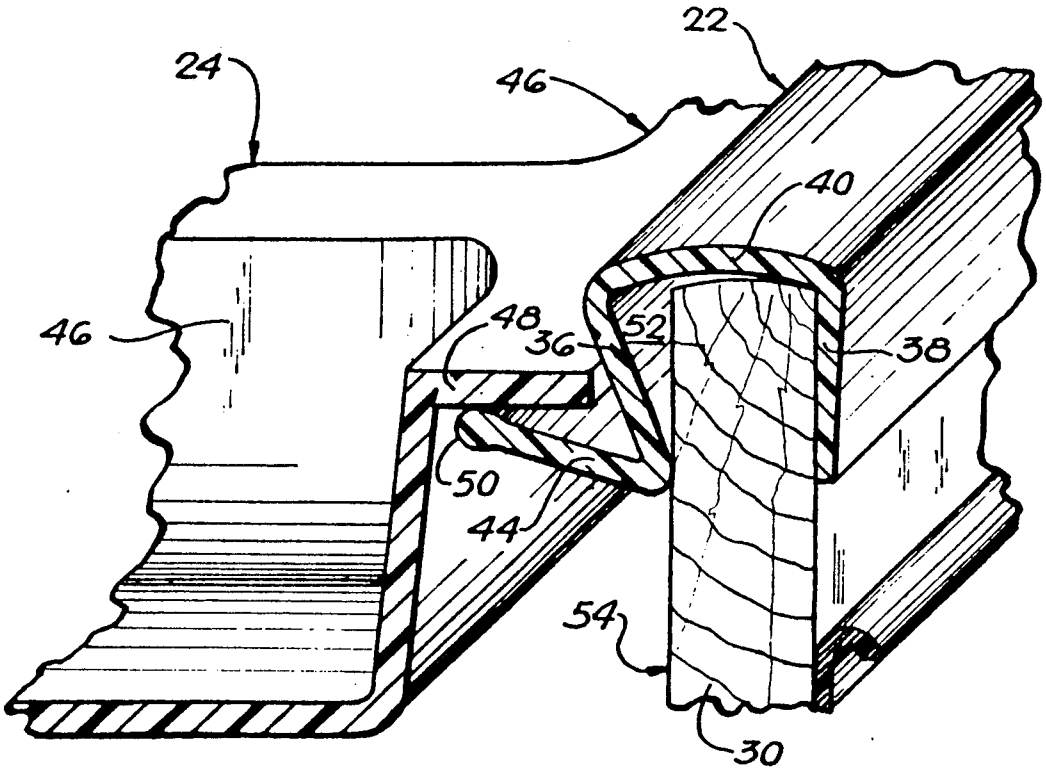
FIG. 6 is a fragmentary enlarged view of FIG. 3 to the same scale as FIG. 5, for ready comparison of one of the glides in both unassembled and assembled modes.

Assembly is carried out simply, without tools, by pressing the glides 22 onto the drawer sides 30 to the positions shown in FIGS. 3 and 6.

The auxiliary organizer tray 24 is preferably made of molded plastic material having recessed compartments 46 for a variety of tools and utensils, and a pair of horizontal flanges 48 at opposite ends. After the glides 22 are assembled on the drawer sides, the tray 24 is placed atop them as shown in FIGS. 3 and 6, with the tray flanges 48 supported for sliding movement on the glide flanges 44.

An important feature of the invention is that the glide transverse flanges 44 are upwardly angularly oriented so they support the auxiliary tray 24 only along their edges, thereby minimizing friction. This combination of edge-support and low-friction plastic material in the glides enables easy movement of the tray comparable to a lubricated or ball bearing support, at very low cost.

To facilitate this smooth, friction-free, sliding contact, the inner edge of each glide is preferably formed with a rounded bead 50 which provides a line contact.

As shown in FIG. 5, the transverse glide flange 44 is initially perpendicular to outer side wall 38, and the inner side wall 36 is diagonal providing the width of downwardly open groove 42 to decrease from top to bottom. When assembled as shown in FIG. 6, this provides a space 52 between the diagonal inner side wall 36 and the inner surface 54 of drawer side 30. This enables the glide to elastically grip a wide range of drawer side thicknesses (from ¼" to ½" in the example given); and flexing of the side and top walls 36 and 40, respectively, as the glide is pressed onto the drawer sides tilts the transverse flanges 44 upwardly providing the line contact with bead 50 as described.

A wide variety of auxiliary trays may be used with the present invention. For example, instead of the storage tray 24, a cutting board 56 with end flanges 58, 58 supported on glides 22, 22 may be kept out of sight, and readily lifted out for use when needed. This keeps food preparation areas clean and neat and reduces clutter on the countertop.

The organizer can be removed readily from the drawer simply by removing the glides without defacing the drawer in any way.

While particular examples of the present invention have been shown and described, it will be apparent that changes and modifications may be made without departing from the invention in its broadest aspects. The aim of the appended claims, therefore, is to cover all such changes and modifications included within the spirit and scope of the invention.

The embodiments of the invention in which an exclusive property or privilege is claimed are defined as follows:

1. In a drawer having sides, an organizer comprising a pair of glides and a tray movable on the glides;

each of said glides comprising a pair of side walls interconnected by a top wall and defining a downwardly open groove;

said glides being assembled onto the inner and outer surfaces of the drawer sides by pressing the glides downwardly to receive the upper edges of the drawer sides within the downwardly open grooves;

said glides having generally transverse flanges extending lengthwise of the glides inside the drawer at a level below the tops of the drawer sides; and said tray having horizontal flanges along opposite edges thereof slidably engaged with said generally transverse flanges on the glides for movement within the drawer.

2. In a drawer, an organizer according to claim 1 in which one of the side walls of each glide that is located on the inner surface of the drawer is a diagonal side wall making the downwardly open groove narrower at the bottom than at the top, and said diagonal side wall is elastically biased toward the other sidewall to thereby elastically grip said upper edges of the door sides between said side walls.

3. In a drawer, an organizer according to claim 1 in which said generally transverse flanges are diagonally upwardly inclined to enable the outer edges thereof to provide a line contact engagement with the horizontal flanges on the tray.

4. In a drawer, an organizer according to claim 1 in which the outer edges of said generally transverse flanges have beaded arcuate surfaces providing line contact engagement with the horizontal flanges on the tray.

5. In a drawer, an organizer according to claim 1 in which the glides are extrusions of low friction plastic material.

6. In a drawer, an organizer according to claim 1 in which the generally transverse flanges extend from the bottom edges of the glides.

7. In a drawer, an organizer according to claim 1 in which each of said transverse flanges is positioned along the lower edge of one of said side walls on the inner surface of a corresponding drawer side and is inclined upwardly to provide a line contact engagement with a corresponding horizontal flange on the tray, and said one side wall extends diagonally downwardly from said top wall to the bottom of said groove thereby providing a clearance space between said one side wall and said inner surface of the corresponding drawer side while the lower edge of said one side wall engages said inner surface of the corresponding drawer side.

8. An organizer for a drawer having sides, said organizer comprising a pair of glides and a tray movable on the glides;

each of said glides comprising a pair of side walls interconnected by a top wall and defining a downwardly open groove;

said glides being assembleable onto the inner and outer surfaces of the sides of a drawer by pressing the glides downwardly to receive the upper edges of the drawer sides within the downwardly open grooves;

said glides having generally transverse flanges extending lengthwise of the glides at a level below the top walls of the glides and adapted to be positioned on the inside surfaces of the drawer sides when assembled thereon; and said tray having horizontal flanges along opposite edges thereof slidably engageable with said generally transverse flanges on the glides for movement within a drawer on which the glides are assembled.

9. An organizer according to claim 8 in which one of the side walls of each glide that is adapted to be located on the inner surface of a drawer is a diagonal side wall making the downwardly open groove narrower at the bottom than at the top, and said diagonal side wall is elastically biased toward the other sidewall to thereby elastically grip said upper edges of the door sides between said side walls.

10. An organizer according to claim 8 in which said generally transverse flanges are diagonally upwardly inclined to enable the outer edges thereof to provide a line contact engagement with the horizontal flanges on the tray.

11. An organizer according to claim 8 in which the outer edges of said generally transverse flanges have beaded arcuate surfaces providing line contact engagement with the horizontal flanges on the tray.

12. An organizer according to claim 8 in which the glides are extrusions of low friction plastic material.

13. An organizer according to claim 8 in which the generally transverse flanges extend from the bottom edges of the glides.

14. An organizer according to claim 8 in which each of said transverse flanges is positioned along the lower edge of one of said side walls which is adapted to be positioned on the inner surface of a corresponding drawer side and is inclined upwardly to provide a line contact engagement with a corresponding flange on the tray, and said one side wall of each glide extends diagonally downwardly from said top wall to the bottom of said groove thereby providing a clearance space between said one side wall and said inner surface of a corresponding drawer side while the lower edge of said one side wall engages said inner surface such corresponding drawer side.

* * * * *